US005335814A

United States Patent [19]

Hepp

[11] Patent Number: 5,335,814

[45] Date of Patent: Aug. 9, 1994

[54] STACKABLE TRAY DISPLAYING SODA BOTTLES

[75] Inventor: James Hepp, Glen Cove, N.Y.

[73] Assignee: All Stock Displays Inc., Glen Head, N.Y.

[21] Appl. No.: 104,356

[22] Filed: Aug. 9, 1993

[51] Int. Cl.[5] ..... B65D 21/02

[52] U.S. Cl. ..... 220/509; 220/519; 206/511; 206/518; 206/506; 206/427

[58] Field of Search ..... 206/503, 505, 506, 509, 206/511, 515, 518, 427; 220/509, 512, 513, 515, 519, 23.83, 23.86, 23.6

[56] References Cited

U.S. PATENT DOCUMENTS

| | | | |
|---|---|---|---|
| 4,344,530 | 8/1982 | deLarosiere | 206/509 |
| 4,599,314 | 7/1986 | Shami | 206/509 |
| 4,773,554 | 9/1988 | Warwick | 206/509 |
| 4,895,256 | 1/1990 | Johnston | 206/511 |
| 4,899,874 | 2/1990 | Apps et al. | 206/427 |
| 4,901,857 | 2/1990 | Emerick | 206/427 |
| 4,928,841 | 5/1990 | Arthurs | 206/427 |
| 5,137,146 | 8/1992 | Stonehouse | 206/509 |

*Primary Examiner*—Stephen Castellano
*Attorney, Agent, or Firm*—Kane, Dalsimer, Sullivan, Kurucz, Levy, Eisele and Richard

[57] ABSTRACT

The device includes a tray for bottles, particularly two-liter soda bottles, wherein the bottle retaining pockets include raised portions for engaging, and thereby being supported by, the caps of the bottles from a lower tray. The tray includes vertical channels with a stop element to allow rods to be inserted between the trays to support the trays at a given distance from one another in a display configuration. The tray further includes male and female elements for the locking nestable configuration of successive empty trays.

10 Claims, 6 Drawing Sheets

STACKABLE TRAY DISPLAYING SODA BOTTLES

BACKGROUND OF THE INVENTION

1. Field of the Invention

This invention pertains to trays for the shipping and display of soda bottles, particularly two-liter bottles, wherein the trays can be configured in any of three different ways. Firstly, during the shipping of the bottles and trays, the tops of bottles from downwardly vertically adjacent trays engage female elements within the bottom surfaces of the trays. Secondly, during the display of the bottles at the retail establishment, the trays are separated by vertical rod elements thereby forming a stable, aesthetically pleasing display rack and allowing the customer access to any of several trays disposed vertically with respect to each other. Thirdly, the empty trays are nestably stackable with each other in a compact configuration.

2. Description of the Prior Art

In the prior art, it is well known to use two-liter polyethylene terephthalate (PET) bottles for the sale of soft drinks and other beverages. These PET bottles offer the advantages of being light-weight, transparent, and inexpensive. Additionally, the ability of these PET bottles to bear high compressive loads along their longitudinal axis has allowed prior art shipping trays to be designed which direct compressive loads through the bottles during shipping thereby replacing non-recyclable full-height cardboard shipping cartons. Examples of such prior art shipping trays are disclosed in U.S. Pat. Nos. 4,899,874, 4,978,002 and 5,060,819 (a similar tray for cans is disclosed in U.S. Pat. No. 5,184,748). However, these prior art shipping trays do not provide for a convenient, or for that matter, aesthetic, display at the retail establishment. That is, the display at the retail establishment would frequently be merely the shipping configuration—alternating layers of bottles and trays with the bottles supporting the trays immediately thereabove. This meant that a customer could select bottles only from the top tray, that top trays would have to be removed from the display as soon as they were empty, and that careless removal of the bottles could cause imbalance in the display, possibly causing the collapse of the display and other-than-axial forces to be applied to the lower bottles thereby rupturing the bottles.

Moreover, the frequent removal of successive empty trays presents an aesthetic problem in that the empty trays are frequently stacked or even strewn in the vicinity of the display causing not only unsightliness but also a safety hazard. Additionally, the cluttered topography of these trays contributes to the unsightliness both of the display and of the collection of empty trays stacked or strewn nearby.

OBJECTS AND SUMMARY OF THE INVENTION

It is therefore an object of this invention to provide a tray for bottles, particularly soft drink bottles, which will allow the bottles to be shipped in a configuration wherein the trays hold upwardly adjacent bottles yet are supported by the downwardly adjacent bottles from a successive lower tray.

It is therefore a further object of this invention to provide a tray for bottles, particularly two-liter soft drink bottles, which can be configured in a display to provide stability and access to any of several trays disposed vertically with respect to each other in a stack-like configuration.

It is therefore a still further object of this invention to provide a tray for bottles, particularly two-liter PET soft drink bottles, which can be configured in a display of several trays disposed vertically with respect to one another yet providing access to any of several trays without the necessity of removing empty uppermost trays from the display.

It is therefore a still further object of this invention to provide a tray for bottles, particular two-liter PET soft drink bottles, which, when empty, can be nestably stacked in a vertical configuration with respect to similar trays.

It is therefore a final object of this invention to provide a tray for bottles, particularly two-liter PET soft drink bottles, which has a clean and aesthetic topography.

These and other objects are achieved by providing a device which includes a tray for bottles, particularly two-liter soda bottles, wherein the bottle retaining pockets include raised portions for engaging, and thereby being supported by, the caps of the bottles from a lower tray. The tray includes vertical channels with a stop element to allow rods to be inserted between the trays to support the trays at a given distance from one another in a display configuration.

The upper surface of the tray includes two oppositely opposed gently sloped surfaces rising to an apex or longitudinal ridge. This longitudinal ridge includes female elements which engage corresponding male elements on the lower surface of an upwardly adjacent tray.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
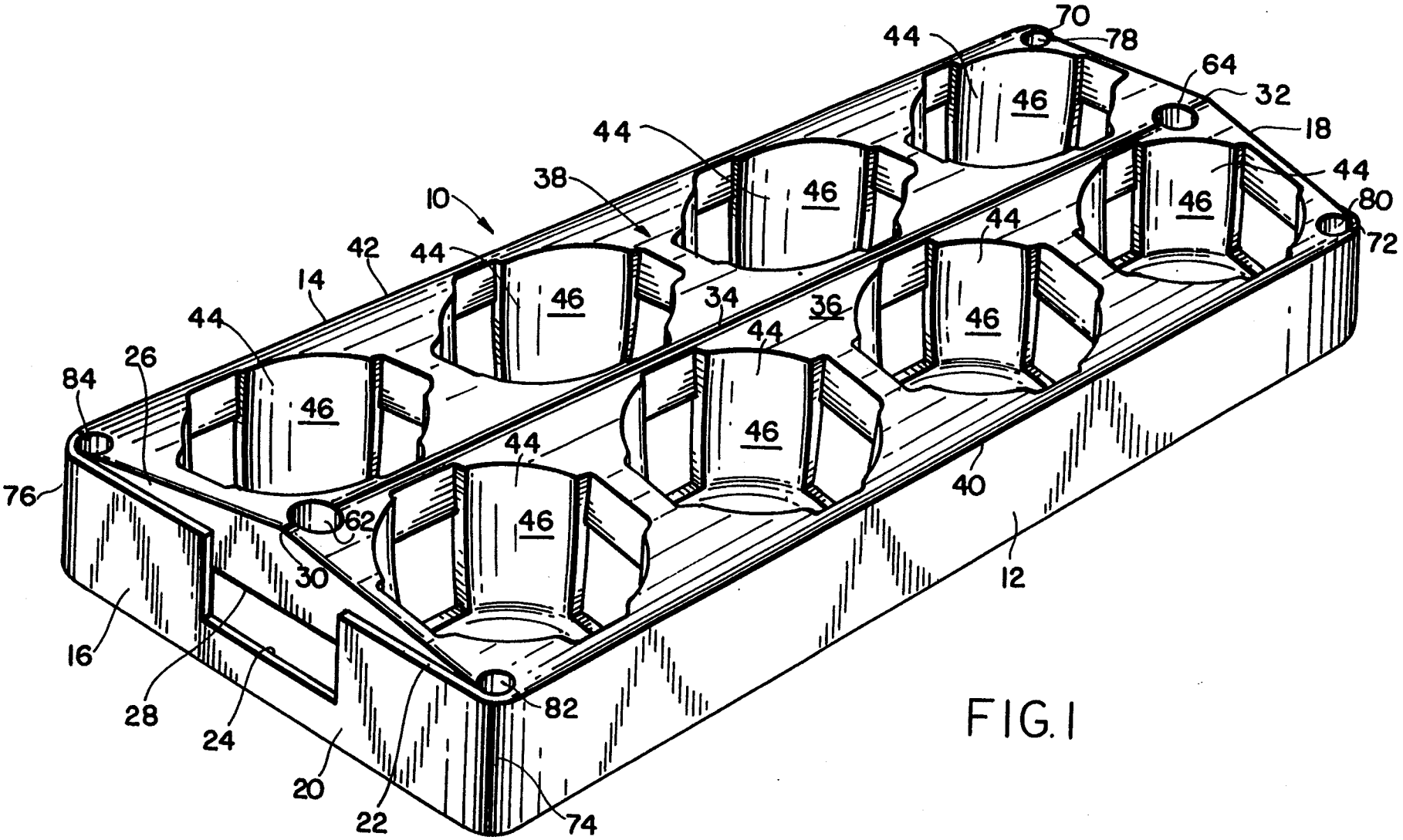
FIG. 1 is a top perspective view of the tray of the present invention.

Referring now to the drawings in detail wherein like numerals indicate like elements throughout the several views, one sees that FIG. 1 is a front perspective view of the tray 10 of the present invention. Tray 10 includes longer vertical upstanding sidewalls 12, 14 perpendicular with shorter vertical upstanding sidewalls 16, 18 thereby forming a rectangular profile as viewed from above or below (see FIGS. 2 and 3). Shorter vertical upstanding sidewall 16 (as well as shorter vertical upstanding sidewall 18 which is obscured from view in FIG. 1) includes outward planar portion 20 with an upper horizontal surface 22 which is generally the same height as longer vertical upstanding sidewalls 12, 14. Centrally located on upper horizontal surface 22 is notch 24 extending downwardly from upper horizontal surface 22 into planar portion 20 of shorter vertical upstanding sidewall 16. Shorter vertical upstanding sidewall 16 further includes inward planar portion 26 formed inwardly adjacent from outward planar portion 20 and rising upwardly from an inward lower surface 28 at approximately a vertical mid-point of notch 24. The opening of notch 24 as bounded by inward lower surface 28 thereby forms a handle for securely gripping tray 10. Inward planar portion 26 rises above upper horizontal surface 22 in a shallow taper thereby forming apex 30. Apex 32 is similarly formed on shorter vertical upstanding sidewall 18. Longitudinal apex or ridge 34 is formed between apices 30 and 32.

Upper inclined surfaces 36, 38 rise from the upper vertical surfaces 40, 42 of longer vertical upstanding sidewalls 12, 14, respectively, to meet at longitudinal apex 34. Upper inclined surfaces 36, 38 each include four bottle retaining pockets 44. As seen from FIGS. 2 and 3, bottle retaining pockets 44 have a circular cross section as viewed from directly above or below (so as to hold the soft drink bottles vertically), but have a somewhat elliptical cross section as they intersect upper inclined surfaces 36, 38.

Bottle retaining pockets 44 are preferably sized to retain standard two-liter soft drink bottles, but those skilled in the art will readily realize that tray 10 is adaptable to other bottle sizes and shapes.

Figure 2:
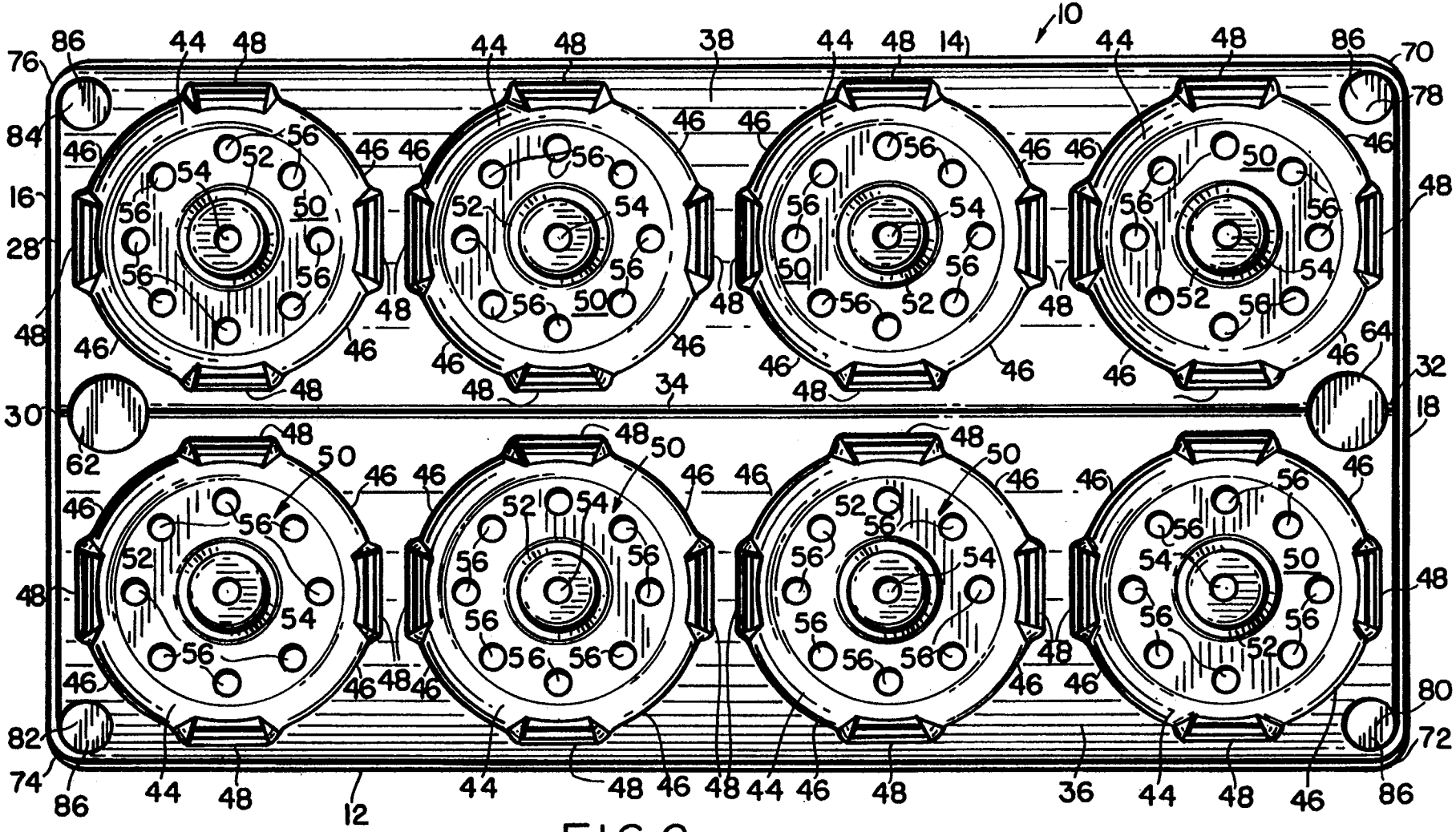
FIG. 2 is a top plan view of the tray of the present invention.
Figure 3:
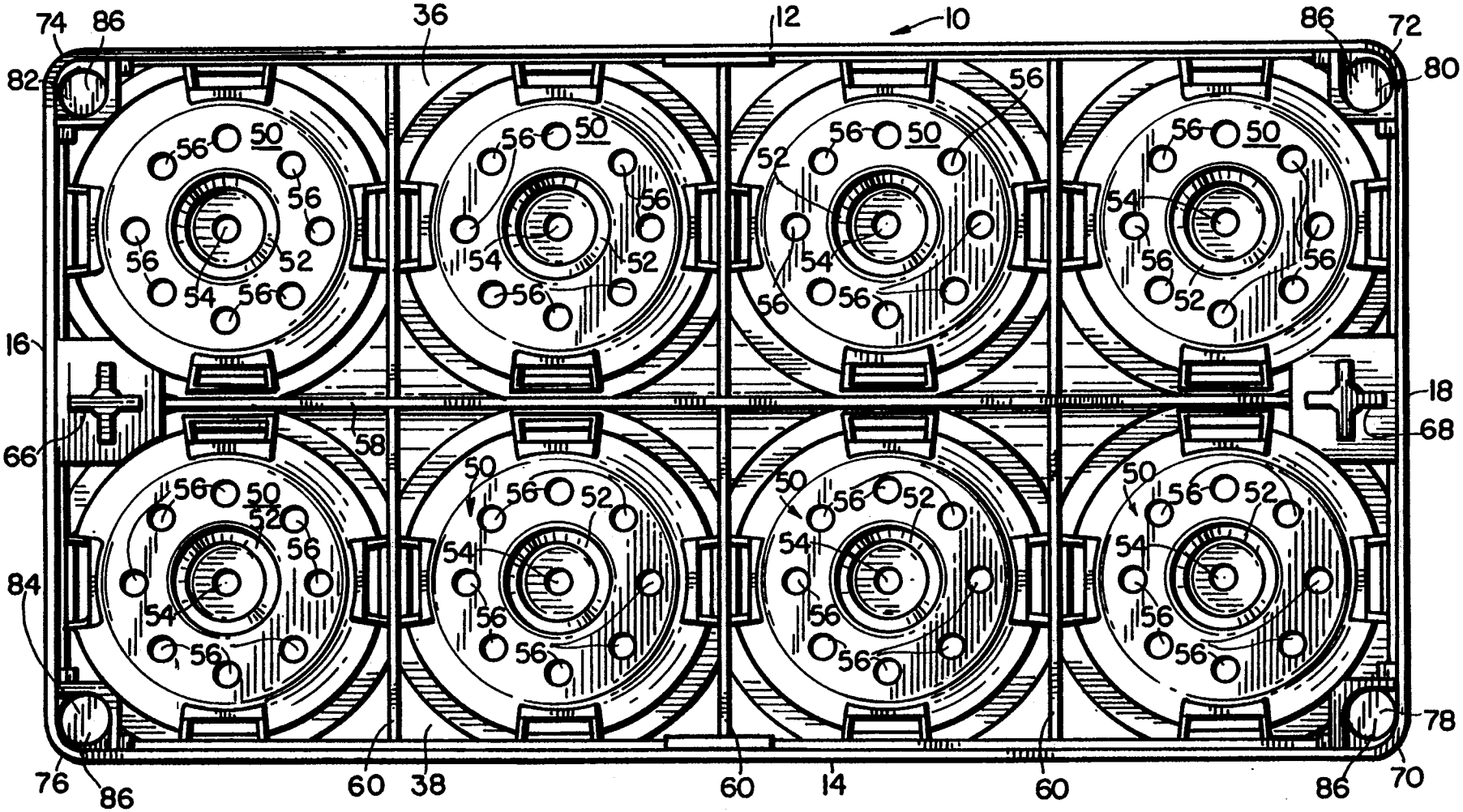
FIG. 3 is a bottom plan view of the tray of the present invention.
Figure 6:
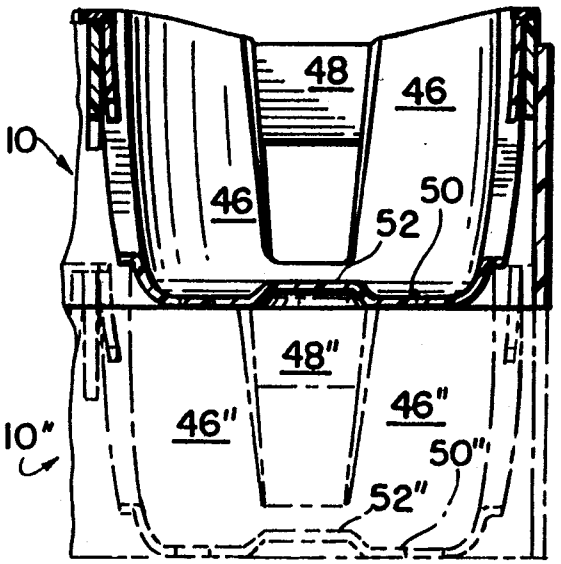
FIG. 6 is a side plan view, partly in phantom, partly in cross-section, of a plurality of stacked empty trays of the present invention.

As can be seen from FIGS. 1, 2 and 3, bottle retaining pockets 44 include four downwardly extending solid walls 46 alternating with four downwardly extending partially open walls 48. Partially open walls 48 are of a somewhat greater diameter than solid walls 46. As shown in FIG. 6, solid walls 46, and to a lesser extent, partially open walls 48, curve at their downward ends to form horizontal floors 50 of bottle retaining pockets 44. As shown in FIG. 6, bottle retaining pockets are somewhat larger at their upwardly extending open end so as to allow the horizontal floor 50 of bottle retaining pocket 44 to nest within the bottle retaining pocket 44″ of a lower tray 10″. As further shown in FIG. 6, the central portion of horizontal floor 50 includes raised portion 52. Raised portion 52 is used to engage a bottle from a downwardly adjacent tray 10″ during shipping. As shown in FIGS. 2 and 3, raised portion 52 includes aperture 54 and the peripheral portion of horizontal floor 50 likewise includes apertures 56.

As shown in FIG. 3, longitudinal brace 58 and latitudinal braces 60 are formed between bottle retaining pockets 44 in the space formed under upper inclined surfaces 36, 38.

Figure 5:
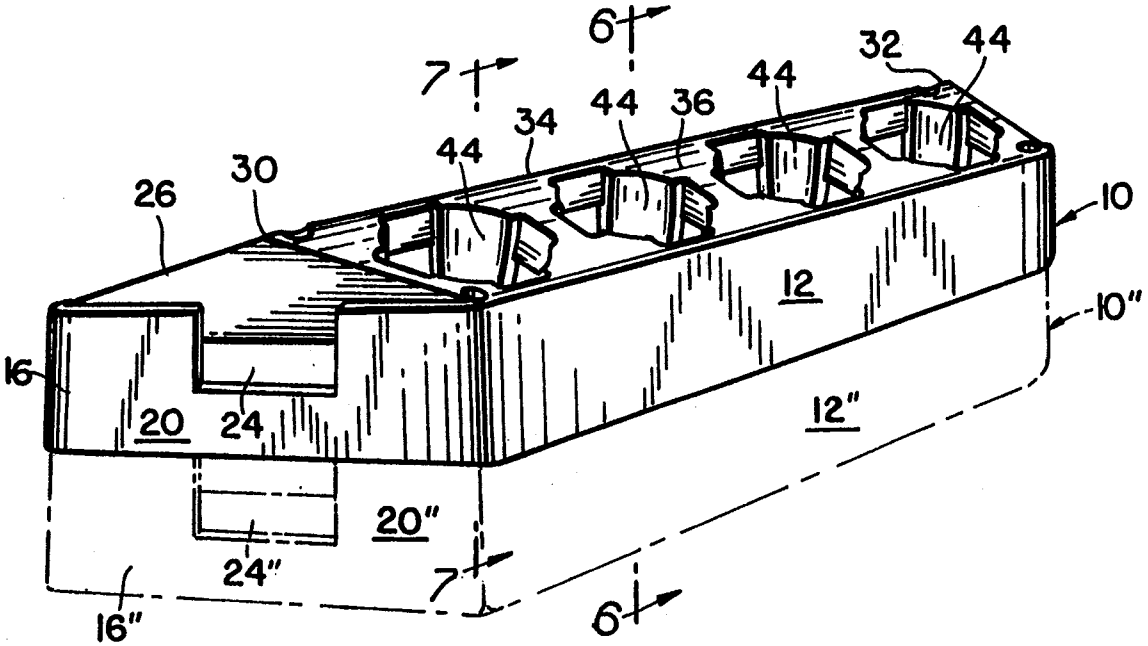
FIG. 5 is a front perspective view, partly in phantom, of a plurality of stacked empty trays of the present invention.
Figure 8:
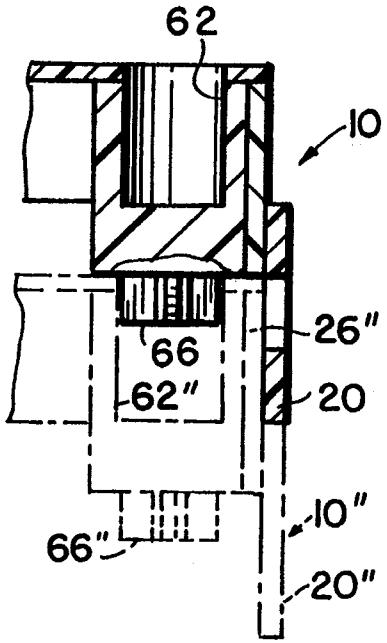
FIG. 8 is a cross-sectional view, partly in phantom, showing the engagement of male and female portions of successive stacked empty trays of the present invention.

As shown in FIGS. 1 and 2, longitudinal apex 34 includes female locking elements 62, 64 immediately inwardly adjacent to apices 30, 32, respectively. As shown in FIG. 3, directly under female locking elements 62, 64 are downwardly extending male locking elements 66, 68. Downwardly extending male locking elements 66, 68 are illustrated with an X-shaped cross section with a diameter equal to that of the female locking elements 62, 64. However, other cross sections, such as cylindrical, are equally suitable for the downwardly extending male locking elements 66, 68. When empty trays 10, 10″ are stacked as generally shown in FIGS. 5 and 6, the inward planar portion 26″ (see FIG. 8) of shorter vertical upstanding sidewall 16″ of lower tray 10″ engages inwardly from the outward planar portion 20 of upper tray 10. In this configuration, as shown in FIG. 8, male locking element 66 of upper tray 10 extends downwardly into female locking element 62″ thereby forming a detent arrangement and vertically aligning outward planar portion 20 of upper tray 10 with outward planar portion 20″ of lower tray 10″. Male locking element 68 and female locking element 64 engage similarly thereby nestably locking the empty trays 10, 10″ together as generally shown in FIG. 5. Of course, several trays can be nestably locked together in a similar manner.

Figure 4:
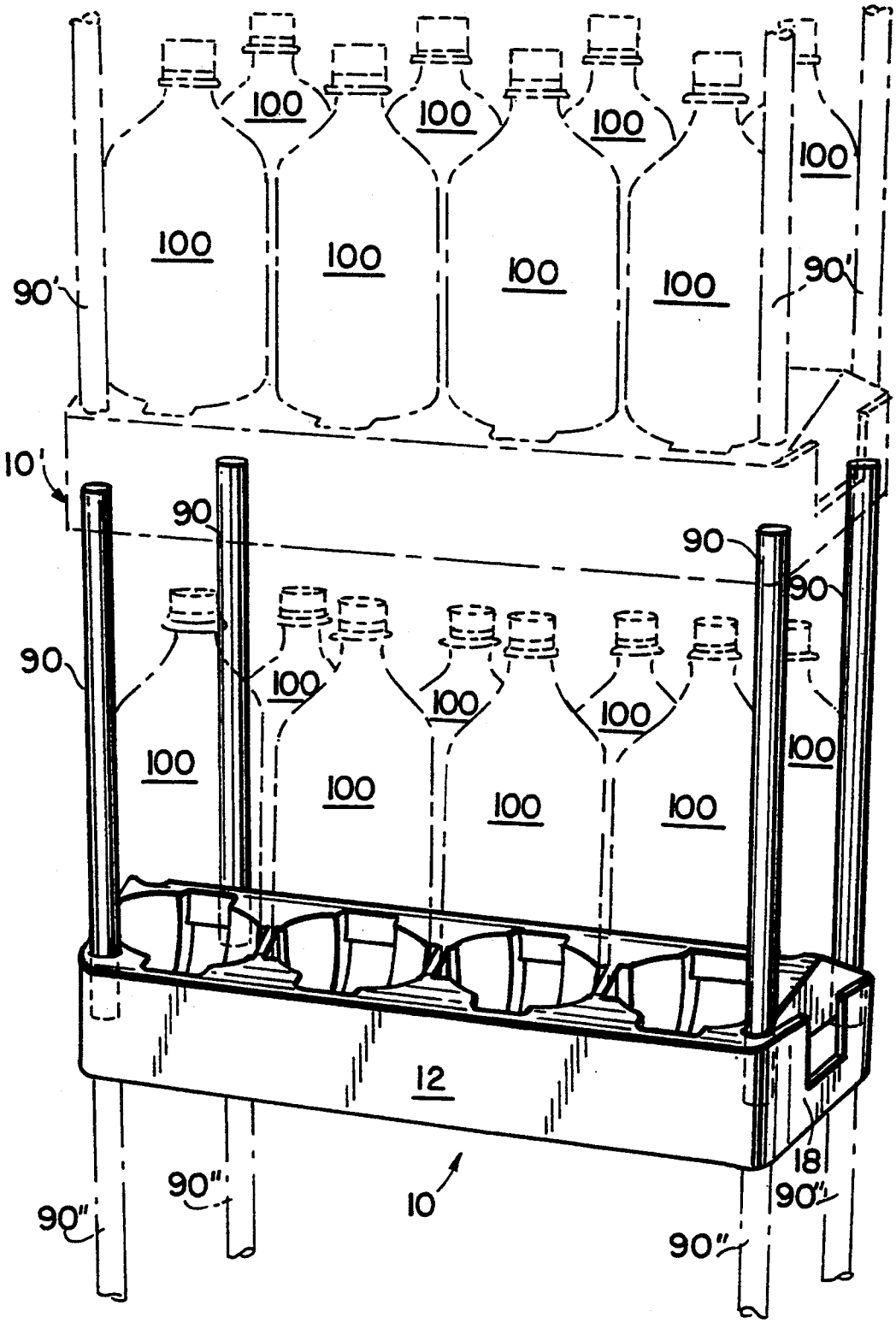
FIG. 4 is a front perspective view, partly in phantom, partly in cross section, of a plurality of trays of the present invention with bottles in a display configuration.
Figure 7:
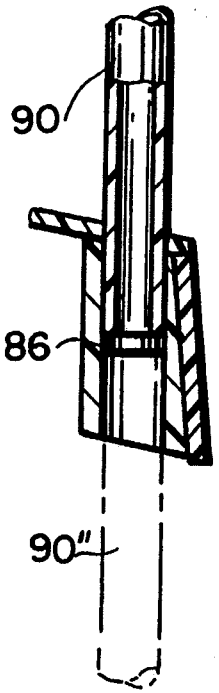
FIG. 7 is a cross-sectional view, partly in phantom, showing the engagement of rods to a tray of the present invention to form a display of successive trays of the present invention as shown in FIG. 4.

As shown in FIG. 1, 2 and 3, rounded corners 70, 72, 74, 76 are formed at the intersections of sidewalls 12, 14, 16, 18. Vertical channels 78, 80, 82, 84 are formed inwardly from rounded corners 70, 72, 74, 76, respectively. As shown in FIGS. 2, 3 and 7, channels 78, 20, 82, 84 include stops 86 at a central point therein. Stops 86 are used to support rods 90, 90′ as shown in FIG. 7, thereby configuring the tray 10 and upper tray 10′ as a display for bottles 100 (shown in phantom) as shown in FIG. 4. The display in FIG. 4 provides a stable configuration to display bottles 100 while allowing the consumer access to bottles 100 on any tray.

Tray 10 is typically first used as a shipping tray with the tops of bottles 100 directly engaging the raised portions 52 of immediately upwardly adjacent tray 10′. A plurality of trays 10 is then used in a display configuration as shown in FIG. 4, with rods 90, 90′, 90″ separating the trays 10, 10′, 10″. After the trays 10 are empty, the trays 10 can be nestably stacked as shown in FIG. 5 and returned to the wholesale facility.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A nesting tray for shipping bottles, comprising:

vertically extending sidewalls about a periphery of the nesting tray;

an upper face extending from said sidewalls, said upper face including a plurality of bottle retaining pockets;

vertical channels inwardly adjacent from said vertically extending sidewalls, said vertical channels including means for engaging a rod for disposing a substantially identical successive lower tray and a substantially identical successive upper tray a vertical distance therefrom; and nesting means for engaging the substantially identical successive lower and upper trays to the nesting tray;

wherein said sidewalls include a first pair of parallel sidewalls intersecting with a second pair of parallel sidewalls, and wherein said first pair of sidewalls includes an outward portion and an inward portion, said outward portion of a height equal to a height of said second pair of sidewalls, said inward portion extending above the height of said outward portion and being inset from said outward portion to upwardly engage into the substantially identical successive upper tray so that said inward portion of said nesting tray is immediately inwardly adjacent from and engaging the outward portion of the substantially identical successive upper tray thereby forming at least a portion of said nesting means wherein said inward portion of one of said first pair of sidewalls includes first and second opposed sloping edges meeting in an apex.

2. The tray of claim 1 wherein said means for engaging a rod includes a stop within said vertical channel.

3. The tray of claim 2 wherein said stop includes a blockage of said vertical channel.

4. The tray of claim 1 wherein said nesting means includes a female element extending in a first vertical direction and a male element extending in a second vertical direction, said first vertical direction being an opposite of said second vertical direction, wherein one of said male element and said female element of said nesting tray is adapted to engage a complementary one of said female element and said male element of the substantially identical successive upper tray when said bottle retaining pockets of said nesting tray are empty and the substantially identical successive upper tray is stacked upon said nesting tray.

5. The tray of claim 4 wherein said male element is downwardly extending from said nesting tray and said female element is formed in said upper face.

6. The tray of claim 1 wherein said upper face includes first and second opposed sloping surfaces corresponding to said first and second opposed sloping edges, and said sloping surfaces meeting in a ridge extending from said apex of one of said first pair of sidewalls to an apex of another of said first pair of sidewalls.

7. The tray of claim 6 wherein said female element is formed on an upper surface of said ridge and said male element is formed directly underneath said female element on an undersurface of said ridge.

8. The tray of claim 7 wherein said bottle retaining pockets include downwardly extending walls with a floor therebetween and said floors include an upwardly extending portion for engaging a cap of a bottle directly therebeneath.

9. The tray of claim 8 wherein said means for engaging a rod includes a stop within said vertical channel.

10. The tray of claim 9 wherein said stop includes a blockage of said vertical channel.

* * * * *